United States Patent [19]

Slamecka

[11] Patent Number: 4,565,911

[45] Date of Patent: Jan. 21, 1986

[54] HIGH-VOLTAGE CIRCUIT-BREAKER

[76] Inventor: Ernst Slamecka, Alt-Pichelsdorf 13, D-Berlin 20, Fed. Rep. of Germany

[21] Appl. No.: 521,536

[22] Filed: Aug. 9, 1983

[51] Int. Cl.[4] ..... H01H 33/88

[52] U.S. Cl. ..... 200/148 A; 200/148 R

[58] Field of Search ..... 200/148 A, 148 R, 148 D

[56] References Cited

U.S. PATENT DOCUMENTS

| | | | |
|---|---|---|---|
| 4,086,461 | 4/1978 | Gonek | 200/148 D |
| 4,146,763 | 3/1979 | Handke | 200/148 A |
| 4,514,605 | 4/1985 | Pham Van | 200/148 A |

FOREIGN PATENT DOCUMENTS

| | | | |
|---|---|---|---|
| 2759264 | 7/1979 | Fed. Rep. of Germany | 200/148 A |

*Primary Examiner*—Robert S. Macon

[57] ABSTRACT

In a dual-gas-blast puffer-type circuit-breaker a fixed insulating nozzle body (4) is integrated into a fixed insulating piston (10), forming thus a structural component. Said structural component is mounted on a fixed cylinder (11). Up to the large inner diameter of the latter the nozzle contour may expand freely, allowing thus a more effective removal of the arc plasma from the nozzle region.

This feature facilitates interrupting the arc by increasing the cooling rate of the gas flow past the arc.

The movable arc contact piece (17) is provided with a conical transition member between the nozzle shaped inlet side and the cylindrical base (16). That conical transition member is working like a movable piston exposed to the downstream gas flow pressure. Thus at least partly a selfcompensation of the increased gas pressure on the compression cylinder takes place in cases where large short circuit-currents are to be interrupted. This feature represents the precondition for a simple and thus reliable drive.

2 Claims, 1 Drawing Figure

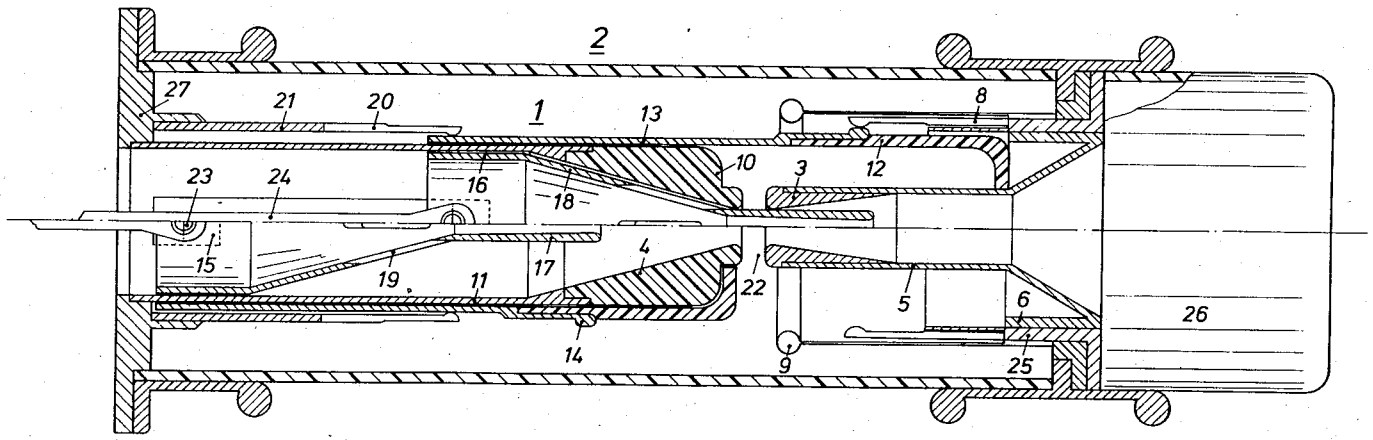
26
25
6
8
5
12
3
9
10
22
13
4
2
14
18
17
1
16
11
20
19
21
24
23
15
27

HIGH-VOLTAGE CIRCUIT-BREAKER

SUBJECT OF THE INVENTION

This invention relates in particular to a $SF_6$-circuit-breaker which relies on a pump or puffer for forcing a blast of relatively cool gas into the arcing region of the circuit-breaker to promote arc extinction.

BACKGROUND OF THE INVENTION

The U.S. patent application, Ser. No. 06/355,517, Filing Date 03/08/82, discloses such a gas-blast puffer-type circuit-breaker wherein a dual-blast nozzle arrangement comprises a first nozzle being made of electrically conductive material, and a second nozzle being made of electrically insulating material.

A movable compression cylinder at least partly made of electrically insulating material is provided with a tube-shaped contact piece which has to carry mainly the continuous current of the circuit-breaker.

During a current interruption the arc current is conducted by a likewise nozzle shaped contact piece being mounted on a metal cylinder sliding inside of a gas pipe and current conductor. Said sliding metal cylinder is rigidly connected with electrically conducting parts of said compression cylinder.

As a particularity of that design appears that the inner width of said gas pipe and current conductor is comparatively rather narrow. Thus the expansion of the insulating nozzle is limited, and that of the exhaust, too.

Both features result in a certain limitation of the high-current interrupting capability which in principle is inherent to the dual-blast nozzle arrangement as described.

As a relief of the narrow cross-sectional area of the gas-pipe the connecting rods for the actuation of the movable structural parts have been arranged outside. However, this measure represents only a modest remedy.

OBJECTS OF THE INVENTION

The invention aims at a materially improved exhaustion of the hot gas produced by the arc energy in the nozzle region. This will result in a substantially increased short-circuit current interrupting capability of the circuit-breaker.

Further it is intended to reduce the energy required for the operation of the circuit-breaker. This is a precondition for the introduction of a simple drive.

Finally it is desired to render the design of the interrupting system more straightforward in order to reduce the cost of construction as well as the failure rate.

SUMMARY OF THE INVENTION

The above-noted objects, as well as other objects which will become apparent from the description of a preferred embodiment of the invention are characterized mainly by the following features:

The insulating nozzle body (4) and the body of the compression piston (10) are integrated into a structural unit being supported by a cylindrical member (11) exhibiting a comparatively very large diameter. Into this large width the insulating nozzle can expand freely.

Inside of the insulating nozzle body a cylindrical movable arc contact piece (17) is disposed. It extends conically into the downstream gas pipe and current conductor (16).

The conical transition member is provided with slots (19). Those slots favour at one hand the removal of the arc plasma during the period when the contact piece does not yet clear the throat of the insulating nozzle.

Beyond it they allow the downstream gas to press the exposed surface of said conical element which then acts like a piston assisting the drive of the circuit-breaker.

The gas pipe and arc current conductor (16) is guided by the support cylinder (11). It continues the area of large cross-section for the downstream gas flow.

For the actuation of the compression cylinder and contact pieces a simple connecting rod (24) is provided. Its mechanical coupling to the wide gas pipe (16) is done inside of it. The influence on the gas flow is practically zero.

DETAILED DESCRIPTION OF A PREFERRED EMBODIMENT OF THE INVENTION

The foregoing and other objects, features and advantages of the invention will become apparent from this description of the preferred embodiment of the invention according to the accompanying drawing. It demonstrates a longitudinal sectional view of the switching device (1) inside of the switching chamber (2). For the sake of simplicity, only those structural parts of the circuit-breaker necessary for an understanding are shown.

The applicability of the switching chamber according to the invention as a single switching unit per circuit-breaker pole ranges up to 362 kV rated voltage.

The switching device may be seen in two positions: To the left of the longitudinal axis in the closed position, and to the right in the open position.

As parts of the current interrupting system an electrically conductive nozzle (3) and an electrically insulating nozzle (4) are facing each other axially.

The conductive nozzle (3) is mounted on the first gas pipe (5). After a certain length of cylindrical extension this gas pipe expands conically. At the broad end of the hollow cone a short cylinder (6) is provided for mounting on the construction element (25). It supports the cap (26) into which the hot gas escaping from the nozzle (3) may expand. At the other side the construction element (25) develops into several contact fingers (8). Additionally it supports the shield electrode (9).

The insulating nozzle (4) together with the compression piston (10), which is made also of insulating material, form a structural unit. It is mounted on the pipe (11). Thanks to this arrangement the insulating nozzle (4) may expand freely up to the inner surface of said pipe (11). This wide expansion of the nozzle favours materially the removal of the hot arc plasma what again increases appreciably the short-circuit interrupting performance.

As a further result of the large diameter of the pipe (11) a reliable mounting of the nozzle (4)-piston (10) body is easy to establish.

The compression piston (10) is surrounded in the closed state of the switching device as well as in the open one by the compression cylinder which consists of two parts (12,13). The nozzles (3,4) are surrounded by said cylinder during an opening operation until to the extinction of the arc.

The compression cylinder acts partly also as the movable contact piece for carrying mainly the continuous current. To comply with that function the structural part (13) is formed as a metal tube. At the one end it expands to a large sized contact electrode (14). At the opposite end said tube (13) is connected with the gas pipe and current conductor (16). This connection, however, is not shown in the drawing.

The cross-sectional area of the pipe (16) equals nearly to the cross-sectional area af the pipe (11). Thus the cross-sectional area of the downstream pipe (16) is appreciably larger than that of all other downstream pipes so farknown till today. Inside of this large sized pipe (16) a connecting rod (24) may be arranged easily which practically does not interfere the downstream gas flow. The mechanical coupling is done by means of the bolt (23).

From the movable contact tube (13) the current is taken over at the one side by the already mentioned contact fingers (8) and at the other side by the contact fingers (20). The latter develop from the tube (21) which is mounted on the base (27) wherefrom the current flows to the circuit-breaker terminals, however, not shown here.

In the course of a short-circuit current interruption the fixed tube shaped support (21) of the contact fingers (20) surrounds the movable contact tube (13). In that way any escape of hot ionized gas into the space between the switching device (1) and the inner wall of the switching chamber (2) is effectively prevented. Due to this feature the insulating gas therein is preserved from contamination by the hot arc quenching gas and the decomposition products contained in it.

The movable arc contact piece (17) is at the inlet side also nozzle shaped. This part is continued by the hollow cone (18) and the cylindrical pipe (16).

During an opening operation the arc quenching gas flows through this structural component driven by the pressure difference between the compression cylinder at the one side and the downstream volume at the other side. In the case of the interruption of large short-circuit currents the pressure difference increases appreciably due to the effect of the arc energy.

As far as conventional $SF_6$-puffer-type circuit-breakers are concerned, the increased gas pressure reacts on the drive and needs for compensation an increased supply of outer energy.

In the switching device according to the invention, however, the additional force as produced by the increased gas pressure and working on the drive is at least partly selfcompensated by the pressure of the downstream gas on the outer surface of the cone (18) which is working as a movable piston rigidly connected with the actuating rod.

What I claim as my invention and desire to secure by Letters Patent is:

1. A gas-blast circuit-breaker comprising:

(a) dual-blast nozzle arrangement, one nozzle being made of electrically conductive material, the other nozzle being made of electrically insulating material, both nozzles facing each other in a fixed axial distance;

(b) said dual-blast nozzles, each of them continuing into a pipe structure conducting the downstream gas flow, and being temporarily surrounded by a movable single compression cylinder, cooperating with a fixed piston;

(c) fixed and movable contact pieces, each separated according to carrying continuous and arc current respectively;

the improvement of said circuit-breaker characterize:

(d) in one of said dual-blast nozzles, a nozzle body (4) and a piston body (10) being integrated into a structural unit;

(e) said structural unit being mounted on a pipe shaped body (11);

(f) said pipe shaped body (11) featuring a diameter being at least approximately equal to the diameter of said piston body (10).

2. The invention according to claim 1, wherein:

(a) inside of said nozzle body (4) a movable arc contact piece being arranged;

(b) said arc contact piece (17) continuing by means of a conically shaped body (18) into a pipe shaped body (16);

(c) said pipe shaped body (16) featuring a diameter being equal to or smaller than the diameter of said cylindrical body (11).

* * * * *